United States Patent [19]

Fujiwara et al.

[11] Patent Number: 4,593,989

[45] Date of Patent: Jun. 10, 1986

[54] CHARGE REMOVING DEVICE FOR AN ELECTROPHOTOGRAPHIC COPYING MACHINE

[75] Inventors: Katsuyoshi Fujiwara, Osaka; Hiroshi Uchiyama, Nara, both of Japan

[73] Assignee: Sharp Kabushiki Kaisha, Osaka, Japan

[21] Appl. No.: 616,243

[22] Filed: Jun. 1, 1984

[30] Foreign Application Priority Data

Jun. 10, 1983 [JP] Japan ..... 58-104709

[51] Int. Cl.[4] ..... G03G 15/00

[52] U.S. Cl. ..... 355/3 R; 355/14 E

[58] Field of Search ..... 355/3 ER, 3 CH, 14 CH, 355/7, 25, 82, 61

[56] References Cited

U.S. PATENT DOCUMENTS 3,827,799 8/1974 Koizumi ..... 355/7
4,129,378 12/1978 Ratin et al. ..... 355/7
4,268,164 5/1981 Yajima et al. ..... 355/7
4,303,332 12/1981 Sakai ..... 355/7

FOREIGN PATENT DOCUMENTS 0150859 9/1982 Japan ..... 355/7

*Primary Examiner*—Arthur T. Grimley
*Assistant Examiner*—David Warren
*Attorney, Agent, or Firm*—Birch, Stewart, Kolasch & Birch

[57] ABSTRACT

An electrophotographic copying machine comprises a light beam reflection device, a charge removing device, a developing device, and a control device. The light beam reflection device is operated to reflect light beams from a document image portion and a margin portion to a photoreceptor. The control device causes the charge removing device to remove unnecessary charges in order to erase a latent image corresponding to the margin portion. The developing device is operated to develop the latent image exactly corresponding to the document portion. The control device may comprise a timer or lead switches.

4 Claims, 4 Drawing Figures

CHARGE REMOVING DEVICE FOR AN ELECTROPHOTOGRAPHIC COPYING MACHINE

BACKGROUND OF THE INVENTION

The present invention relates to an electrophotographic copying machine and, more particularly, to a charge removing device for an electrophotographic copying machine.

An electrophotographic copying machine produces an electrostatic latent image on a photoreceptor by way of an optical system. The latent image corresponds to an image on a copy document such as a manuscript or book to be copied. A developing device is provided so that toner particles electrically adhere to the latent image, so that the latent image becomes visible as a toner image. The toner image is transferred onto a copy paper via a transfer charger.

Conventionally, the photoreceptor is uniformly charged and exposed selectively to electromagnetic radiation to form the electrostatic latent image. When a very thick book is to be copied, some portions of the surface of the book, in particular, the gutter margin of an opening page and the fore-edges of the opening page and the remaining pages may inevitably float from the surface of a document table because it is very difficult to uniformly contact all the surface of the book on the surface of the document table. The floating fore-edges are copied to be black or solid. The floating gutter margins are copied to be such an indefinite image that the copied image is not clear, totally.

SUMMARY OF THE INVENTION

Accordingly, it is an object of the present invention to provide an improved visualizing device for forming an electrostatic latent image exactly corresponding to a desired image to be copied.

It is another object of the present invention to provide an improved charge removing device for removing unnecessary charges to distinguish an undesirable image from an image to be copied as an electrostatic latent image in an electrophotographic copying machine.

It is a further object of the present invention to provide an improved electrophotographic copying machine comprising a charge removing device for removing unnecessary charges to distinguish an undesirable image as formed in copying a page of a thick book at gutter margins and fore-edges of the book when laid on a document table.

Briefly described, in accordance with the present invention, an electrophotographic copying machine comprises a light beam reflection means, charge removing means, developing means, and control means. The light beam reflection means is operated to reflect light beams from a document image portion and a margin portion toward photoreceptor means. The control means causes the charge removing means to remove unnecessary charges in order to erase a latent image corresponding to the margin portion. The developing means is operated to develop the latent image exactly corresponding to the document portion. The control means may comprise timer means or lead switch means.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

Figure 1:
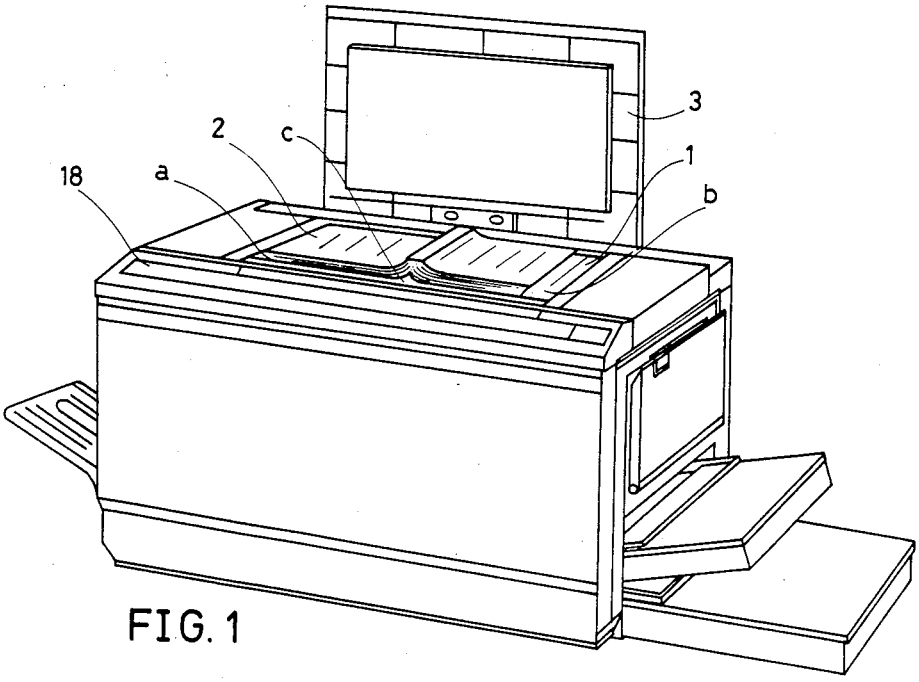
FIG. 1 shows a perspective view of an electrophotographic copying machine according to the present invention.

FIG. 1 is a perspective view of an electrophotographic copying machine of the present invention.

Referring to FIG. 1, the copying machine comprises a document table 1, a document cover 3, a control unit 18, and the remaining parts of the machine as will be described in detail below. On the document table 1, a thick book 2 may be placed as a document to be copied. Inevitably, opening fore-edges a and b, and a opening gutter margin c of the book 2, when laid on the document table 1, may float from the surface of the document table 1.

Figure 2:
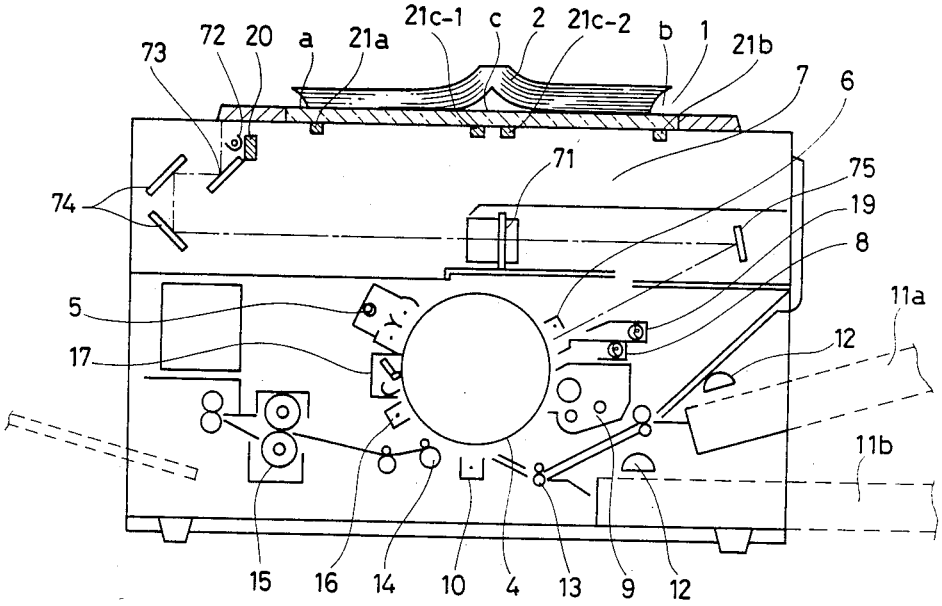
FIG. 2 shows a broken side view of the inner elements of the copying machine of FIG. 1.

FIG. 2 is a broken side view, of the copying machine of FIG. 1.

In the copying machine of FIG. 2, a three-layered photoreceptor 4 is disposed around a rotational drum. Preferably, the photoreceptor 4 comprises an electrically conductive base made of A1, a photoconductive layer thereon made of CdS, and an insulative layer made of Mylar thereover. An example of such a three-layered element and an electrophotographic process used therewith is disclosed in H. Tanaka et al, U.S. Pat. No. 3,666,363 issued May 30, 1972, entitled "Electrophotographic Process and Apparatus". The disclosure of this patent is incorporated herein by reference. The application of the present invention, however, should not be limited to this type of photoreceptor 1.

A first corona charger 5 is provided for initially and uniformly charging the surface of the photoreceptor 4 to a certain first polarity. A second charger 6 is provided for uniformly charging the photoreceptor 4 to cause an AC corona charge or charge in the opposite polarity to the polarity by the first charger 5. A light exposing system is provided for emitting light beams toward the document 4 in synchronization with the activation of the second charger 6 and the rotation of the drum carrying the photoreceptor 4. The reflected light beams are incident upon the photoreceptor 4 through the second charger 6 with an optical system 7 comprising some mirrors and a lens 71 to form an electrostatic latent image. The second charger 6 is provided for passing the reflected light beams toward the photoreceptor 4 and, simultaneously, providing the charge. A magnetic brush developing device 9 is provided for attaching toner particles onto the electrostatic latent image on the photoreceptor 4 to form a toner image. A charge removing lamp 8 is provided for emitting light beams toward the photoreceptor 4 after the second charge 6 is operated. A transfer discharger 10 is provided for corona transfering the toner image onto a copy paper. The copy paper is picked up from a number of copy papers being stored within a cassette 11*a* or 11*b*. Some paper pick-up rollers 12 are provided for picking up a single copy paper from the papers in the cassette 11*a* or 11*b*. Some paper feeding rollers 13 are provided for feeding the picked-up copy paper to the transfer discharger 10.

A charge-removing corona discharger 16 is provided for charging the photoreceptor 4 to a polarity opposite to the polarity of the remaining charges on the photoreceptor 4 to remove the charges from the photoreceptor 4. A cleaning device 17 is provided for removing the remaining toner particles from the surface of the photoreceptor 4 to become ready for the next copying operation. A pair of fixing rollers 15 are provided for pressing the toner image onto the copy paper to fix the toner image thereon. A pair of separation rollers 14 are provided for separating the copied paper from the surface of the photoreceptor 4. An expel tray is positioned to receive an expelled paper from the body of the copying machine.

The optical system 7 includes a light emission device 72 for emitting light beams toward the document table 1, a first mirror 73 for directing the reflected light beams from the surface of the document 2, a second set 74 for directing the reflected beams from the first mirror 73 to a light passway of the lens 71, and a third fixed mirror 75 for reflecting the beams passing along the lens 71 to the photoreceptor 4 through the second charger 6.

Here, the document table 1 is fixed, so that the first mirror 73 is horizontally moved together with the light emitting device 72 to scan the surface of the document 2. The movement speed of the first mirror 73 and the light emitting device 72 is the same as that of the rotation speed of the photoreceptor 4 to provide a life-sized copy. At the same time, the second mirror set 74 is horizontally moved at half speed of the first mirror 73 in the same direction, so that the image portions of the document 2 are subsequently formed on the photoreceptor 4. Of course, it is possible that the optical system 7 is fixed while the document table 1 is reciprocated.

It is to be noted that the application of the present invention should not be limited to the copying machine of the type as shown in FIGS. 1 and 2.

Figure 3:
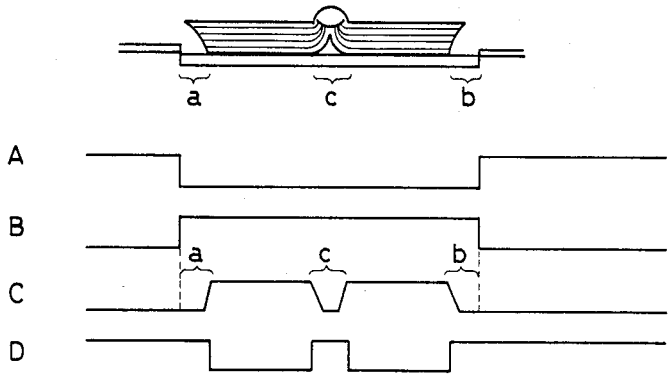
FIG. 3 shows a relationship between the image forming conditions of the copying machine of FIG. 1.

FIG. 3 shows a relationship between the image forming conditions of the copying machine.

As stated above, the opening fore-edges a and b, and the opening gutter margin c of the document, say, a book, when laid on the document table may float from the surface of the document table 1 even when the document cover 3 presses against the spine of the book. Under the circumstances, when the book is copied by activating the light emitting system, the reflected light beams are reduced because of the concavity of the portions a, b, and c, so that the reflected light emission to the photoreceptor 4 is very small. The charges on the photoreceptor 4 thereby remain. Here, the portions of the photoreceptor corresponding to the portions a, b, and c are copied to be black or solid, or so. Condition C in FIG. 3 indicates this phenomenon.

According to the present invention, the control unit 18 comprises a mode switch activated for controlling the energization of the charge removing lamp 19. Since the charge removing lamp 19 is positioned adjacent the second charger 6, the lamp 19 is switched on simultaneously with the energization of the second charger 6 exposing the light beam image. Although somewhat depending upon the size of the book it is reasonably assumed that the length of the fore-edges a and b is within about 10 mm, and the length of the gutter c is within about 20 mm. The unnecessary charges can be removed by changing the position of switching the charge removing lamp 19 on and off withing this region.

By way of example, in case the mode switch of the control unit 18 is operated to select a book-like mode, the charge removing lamp 19 is switched on when the copy starts. When the first mirror 73 reaches the imaging start position, a timer means is started to count a first time of moving the first mirror 73 at about 10 mm from the imaging start position. When the timer means counts this first time, the timer means outputs a first control signal applied to the charge removing lamp 19 to switch the lamp 19 off. The timer means is further activated to count a second time of reaching the first mirror 73 at the c position, so that, when counting, the timer means outputs a second control signal applied to the charge removing lamp 19 to re-switch the lamp 19 on. Still further, the timer means counts a third time of further moving the first mirror 73 at about 20 mm, so that it outputs a third control signal applied to the lamp 19 to switch it off. Finally, the timer means is activated to count a fourth time of moving the first mirror 73 at the opening fore-edge b position, so that the timer means outputs a fourth control signal to the lamp 19 to switch it on. Condition D of FIG. 3 indicates this control phenomenon according to the present invention.

Thus, the charge removing lamp 19 is operated to provide the light beams toward the portions of the photoreceptor 4 corresponding to the non-image portions a, b, and c, the light beam amount being identical with the beam amount to be applied to the non-document portions of the photoreceptor 4. The charges of the portions corresponding to the portions a, b, and c are completely removed. Therefore, no toner particles can be adhered to these portions of the photoreceptor 4 even by the developing device 9, thereby forming no black images.

To control switching the charge removing lamp 19 on and off, it may be necessary to change the illumination time of the lamp 19 although the values of a, b, and c are not changed very much. For this purpose, the counting time of the counter means can be changed depending on the book size. Further, as FIG. 2 shows, a magnet 20 is coupled to the first mirror 73, and lead switches 21*a*, 21*b*, and 21*c* (-1 and -2) can be positioned to designate the positions of the portions a, b, and c, respectively. The lead switches are aligned along the moving way of the magnet 20. It may be possible that the positions of the lead switches can be changed so as to comply with the book size.

When a sheet like document is copied, the mode switch is selected not to be the book-like mode, so that the charge removing lamp 19 is operated in synchronization with the activation of the light emission device 72 as shown in condition B of FIG. 3. Therefore, the lamp 19 is switched off when and after the imaging starts.

Since the three-layered photoreceptor 4 is used, the charge removing lamp 19 is positioned adjacent the second charger 6. If a two-layered photoreceptor may be used, the charge removing lamp 19 can be positioned anywhere in the area from the uniformly charging first charger 5 to the developing device 9. Of course, if the lamp 19 is positioned adjacent the light exposure device including the second charger 6, the lamp 19 can be controlled so as to comply with the scanning of the document, thereby enabling easy controlling.

While only certain embodiments of the present invention have been described, it will be apparent to those skilled in the art that various changes and modifications may be made therein without departing from the spirit and scope of the present invention as claimed.

What is claimed is:

1. A charge removing system for removing charges from a surface of a photoreceptor means to develop a latent image on said photoreceptor means in an electrophotographic copying machine comprising:

a light incident means for directing light beams toward said photoreceptor means, said light beams being reflected from a document to be copied including areas producing false images, such as document edges and a document gutter margin;

a charge removing means for removing unnecessary charges from said surface of said photoreceptor means, said unnecessary charges corresponding to said area of said document producing said false images; and a control means for controlling the activation of said charge removing means said control means comprising a timer means for counting a time of moving said light incident means between a position of scanning the document and a position of scanning the false image producing areas, such as said document edges and document margin, and a lead switch means for sensing whether said document is being scanned or said false image producing areas including said margin is being scanned.

2. The system of claim 1, wherein said charge removing means is positioned between a first charger means and latent image development means, said first charger means being provided for uniformly charging the surface of said photoreceptor means and said developing means being provided for developing said latent image.

3. The system of claim 2, wherein said charge removing means is positioned adjacent a second charger means for uniformly charging the surface of said photoreceptor means to a polarity opposite to that charged by said first charger means for initially and uniformly charging the surface of said photoreceptor means.

4. The system of claim 1, further comprising a control switch for selecting said control means.

* * * * *